US005792996A

United States Patent [19]

Phillips et al.

[11] Patent Number: 5,792,996

[45] Date of Patent: Aug. 11, 1998

[54] AGING RESISTANT, HIGH VOLTAGE NON-CERAMIC INSULATION

[75] Inventors: Andrew John Phillips, WITS, South Africa; David S. Birrell; David J. Childs, both of Lenox, Mass.

[73] Assignee: Electric Power Research Institute, Palo Alto, Calif.

[21] Appl. No.: 721,901

[22] Filed: Sep. 27, 1996

[51] Int. Cl.[6] ..... H01B 17/06

[52] U.S. Cl. ..... 174/174

[58] Field of Search ..... 174/174, 178, 174/209

[56] References Cited

U.S. PATENT DOCUMENTS

| | | | |
|---|---|---|---|
| 2,160,660 | 5/1939 | Hobart | 174/14 |
| 2,732,423 | 7/1956 | Morrison | 174/209 |
| 3,268,655 | 8/1966 | Haigh et al. | 174/146 |
| 3,300,576 | 1/1967 | Hendrix et al. | 174/146 |
| 4,189,392 | 2/1980 | Penneck et al. | 252/63.2 |
| 4,463,219 | 7/1984 | Sato | 174/127 |
| 4,966,635 | 10/1990 | Sato | 148/275 |
| 5,406,033 | 4/1995 | Pazdirek | 174/176 |

OTHER PUBLICATIONS

Dickson and Reynders, "The Effects of Corona on the Surface Properties and Chemical Composition of Silicon Rubber Insulators", *Ninth International Symposium on High Voltage Engineering* (1995).

Phillips et al., "Consideration of Corona Onset From a Water Drop as a Function of Air Pressure", *IEE Proc. Sci. Meas. Technol.* 143(2):125–130 (1996).

Phillips et al., "The Effect of Changes in Air Density on Corona Activity From a Single Droplet in Both a Divergent and Uniform Field", *8th International Symposium on High Voltage Engineering* (1993).

Phillips et al., "The Effect of Changes in Air Density on Corona From a Single Water Droplet—Modelling the Corona Inception Point", *South African Universities Power Engineering Conference* (1994).

Phillips, "The Effect of Changes in Air Density on Corona from Water Drops", Thesis (1994).

Phillips et al., "The Effect of Changes in Air Density on Corona Activiy from a Single Water Droplet", pp. 2.45–2.50 –Oct. 1994.

Phillips et al., "The Effect of Changes in Volume and Air Density on the Corona Onset Potential of Water Drops", *Ninth International Symposium on Voltage Engineering* (1995).

Phillips et al., "Modelling and Measurement of the Corona Inception Point on a Water droplet as a Function of Air Pressure", *IEEE* pp. 115–118 (1994).

*Primary Examiner*—Kristine L. Kincaid
*Assistant Examiner*—Joseph Waks
*Attorney, Agent, or Firm*—Flehr Hohbach Test Albritton & Herbert LLP; William S. Galliani

[57] ABSTRACT

A non-ceramic insulator for high voltage electrical conductors is designed using a combination of materials to form the outermost surface of the insulator. The non-ceramic insulator includes a support structure and one or more weather sheds. The surface characteristics are chosen to give the insulator good contamination and flashover performance while preventing the aging due to corona activity caused by water drops. Also, the weather shed spacing is varied according to the strength of the local electric field. Old non-ceramic insulators are retrofitted to create a combination of aging resistant and hydrophobic surfaces.

3 Claims, 4 Drawing Sheets

22
20
24
22
18
16
20

AGING RESISTANT, HIGH VOLTAGE NON-CERAMIC INSULATION

BRIEF DESCRIPTION OF THE INVENTION

This invention relates generally to high voltage insulators. More particularly, this invention relates to a high voltage, non-ceramic insulator whose surface includes two materials with differing resistivity to damage caused by electrical discharge.

BACKGROUND OF THE INVENTION

In the electric power industry it is important to electrically isolate highvoltage conductors from each other and from electrical or earth ground. This isolation is assured through the use of an insulator. An insulator is commonly implemented as a rigid structure connected between conductors or connected between conductors and ground. Insulators of this type are made from a high impedance material to minimize or eliminate electrical leakage. Many insulators are made of ceramic.

Non-ceramic insulators have recently been used by the electric power industry instead of ceramic insulators where ease of installation and performance in the presence of contamination are of concern. Operation costs and reliability can be improved in many situations by the use of non-ceramic insulators, which commonly consist of pultruded fiberglass rods with continuous glass fibers that are crimped, glued or cast into end fittings compatible with established hardware to carry conductor loads. Variations of these construction techniques are used in many situations, including aerial cable suspension systems, surge arresters, cable terminations, bushings, and switches.

Non-ceramic insulators can be made of many materials, of which fiberglass and rubber are typical. The properties of a specific material play a large role in the performance of the insulator. One of the most important properties is the materials resistivity to damage caused by electrical discharge.

Ethylene-Propylene (EP) type rubbers have been used on insulators. EP-type rubbers are generally very resistant to damage caused electrical discharge. This means that electrical discharge such as leakage currents and corona activity on the surface of the rubber tends not to erode the rubber, cause carbon tracking or cause it to become brittle.

In use, many EP-type rubbers are hydrophilic. Hydrophilic materials are characterized as those materials to which water adheres. Water on the surface of a hydrophilic material spreads out to form a thin film. This causes two related problems. First, an insulator made of hydrophilic materials is not good at resisting contamination. Second, an insulator made of hydrophilic materials allows large leakage currents to flow, which eventually produces arcing, bridging, and flashover failure. EP-type rubbers are resistant to carbon tracking.

Silicone rubbers have been used on insulators in lieu of EP-type rubbers. Silicone rubbers are generally not as resistant to damage caused by electrical discharge as EP-type rubbers. In the presence of leakage currents or corona activity, silicone rubber is eroded or becomes brittle more quickly than EP-type rubbers. Silicone rubbers are also generally resistant to carbon tracking.

Generally, silicone rubbers are hydrophobic. Hydrophobic materials are characterized as those materials to which water does not adhere. Water on the surface of a hydrophobic material beads up and runs off. As a result, insulators made from hydrophobic materials are good at resisting contamination and do not allow leakage currents to flow on the insulator surface.

The beading of water on the surface of an insulator made with a hydrophobic material increases the local electric field in proximity to the water drop, causing a greater occurrence of corona and other discharge activity. In the presence of electrical discharge activity, silicone rubbers may lose their hydrophobicity, become brittle, and crack. Electrical discharge activity also erodes silicone rubbers. This deterioration can lead to the eventual mechanical failure of the insulator.

For the forgoing reasons, there is a need for a non-ceramic insulator for high-voltage conductors which is not susceptible to aging due to electrical discharge activity and at the same time retains superior contamination and flashover performance.

SUMMARY OF THE INVENTION

The present invention is a non-ceramic insulator for high-voltage electrical conductors. The invention comprises a support structure with a fitting area for connection with a high-voltage electrical conductor and one or more weather sheds positioned on the support structure. The surface of the non-ceramic insulator includes a first material and a second material. The first material is more resistant to damage caused by electrical discharge than the second material.

The non-ceramic insulator is divided into a high electric field region and a low electric field region, where the high electric field region includes the fitting area of the support structure. The portions of the insulator in the high electric field region experience a high electric field relative to the portions in the low electric field region.

In one version of the invention, the surfaces of the weather sheds and support structure in the high electric field region of the insulator include the first material. The surfaces of the weather sheds and the support structure in the low electric field region of the insulator include the second material.

In another version of the invention, the entire surface of the support structure includes the first material and the entire surface of the weather sheds includes the second material.

In another version of the invention, the spacing between the weather sheds is varied based on the strength of the local electric field—the space between the weather sheds being greater in areas which are experiencing a high local electric field.

In another version of the invention, the surface of the insulator is comprised of hydrophobic material.

Given the present state of material technology, a trade off must be made with each material between good resistance to damage caused by electrical discharge or good contamination resistance. By using two or more materials or by changing the geometry of the insulator to reduce electrical activity, it is possible to reduce the aging mechanism and therefore slow the deterioration of an insulator in service. The materials used in areas of high electric field can generally be chosen to be less hydrophobic (more hydrophilic) in use, less prone to allow water drop corona, and more resistant to electrical activity. The materials used in areas of lesser electric fields can be generally chosen to be more hydrophobic (less hydrophilic) in use and therefore more resistant to contamination. Water drop corona will not be a problem in areas of low electric field if the local field is below the water drop corona threshold for the insulator design and applied voltage. The non-ceramic insulators of the present invention are less susceptible than prior art non-ceramic insulators to aging due to electrical discharge activity. At the same time, they maintain superior contamination and flashover performance.

BRIEF DESCRIPTION OF THE DRAWINGS

For a better understanding of the nature and objects of the invention, reference should be made to the following detailed description taken in conjunction with the accompanying drawings, in which.

Like reference numerals refer to corresponding parts throughout the several views of the drawings.

DETAILED DESCRIPTION OF THE INVENTION

Figure 1:
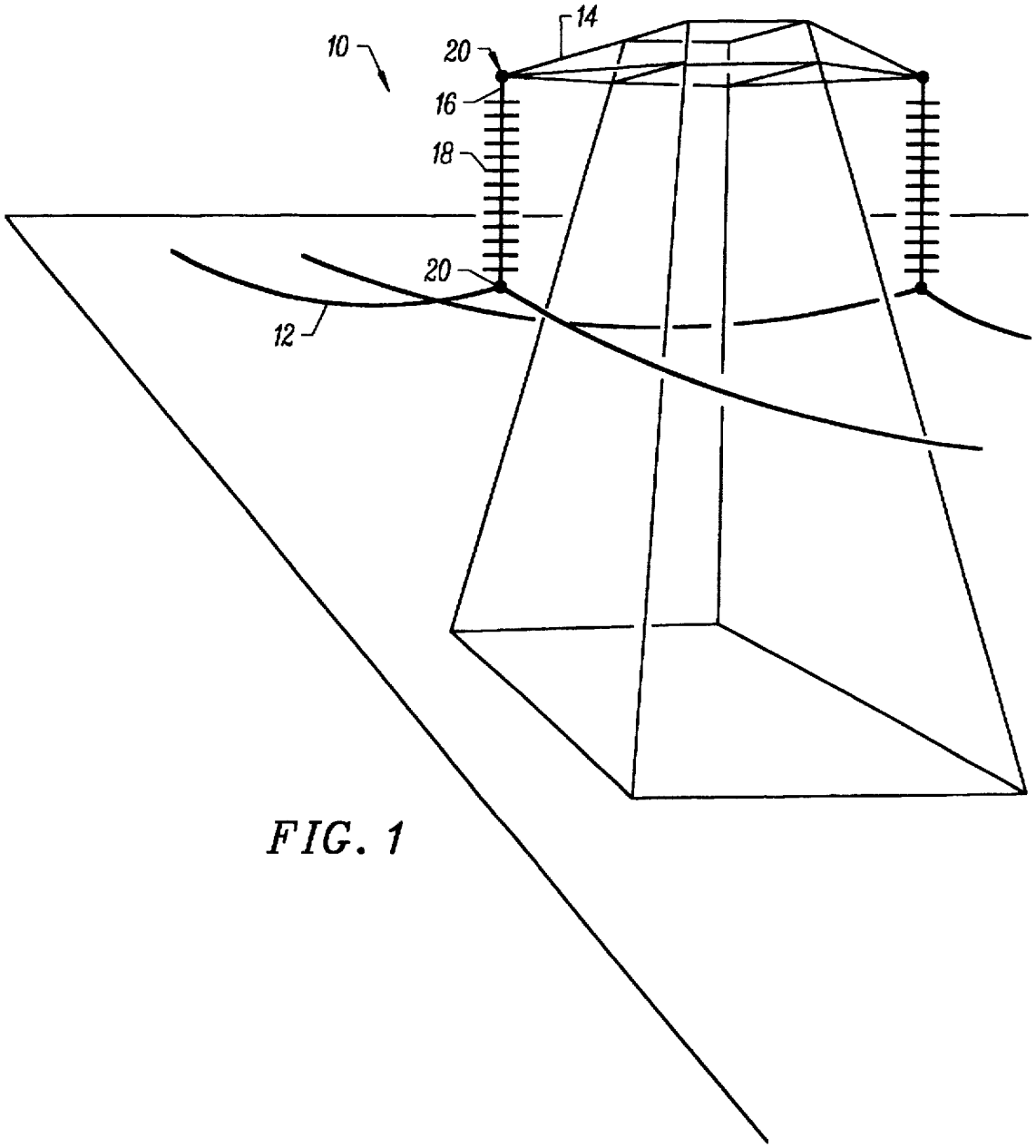
FIG. 1 is an illustration of a typical use for a non-ceramic insulator for high voltage electrical conductors.

FIG. 1 illustrates a typical use for a high-voltage non-ceramic insulator 10. The non-ceramic insulator 10 is shown supporting a suspended aerial cable 12 for high-voltage power transmission. The insulator is also connected to a transmission line tower 14. The insulator 10 both supports the cable 12 and electrically insulates the cable 12 from the tower 14.

The insulator 10 comprises a support structure 16 and weather sheds 18. In the particular embodiment shown in FIG. 1, the support structure 16 comprises a rod with a fitting area 20 on each end of the rod. Each fitting area 20 is fitted with standard hardware such as a hook, clamp, or other device for connecting the rod 16 to the aerial cable 12 and the tower 14. The support structure gives the insulator mechanical integrity.

The weather sheds 18 are spaced along the support structure 16. The weather sheds 18 serve several purposes. First, they provide a concentration point at which water may build up and run off the insulator 10. This prevents streams of water from traversing the distance between the cable 12 and tower 14 which would provide a continuous path for electrical conduction. Second, the sheds 18 increase the leakage distance of the insulator 10, which is the distance along the surface of the insulator 10 between the two fitting areas. An increased leakage distance means that the electricity has a longer distance to travel between the fitting areas. By preventing water from forming a continuous stream between the fitting areas, and by increasing the leakage distance of the insulator 10, the weather sheds 18 greatly reduce the incidence of flashover, bridging, and arcing between the fitting areas.

The insulator 10 is exposed to an electric field due to its proximity to the high-voltage aerial cable 12 and its position between the cable 12 and the tower 14. The highest electric field occurs at the ends of the insulator proximal to the highvoltage aerial cable 12 and the tower 14. The portions of the insulator experiencing these high electric fields are called the high electric field regions of the insulator. These high electric field regions include the fitting areas at the ends of the insulator, a segment of the support structure adjacent to the fitting areas, and at times the weather sheds nearest to the fitting areas. The portion of the insulator between the high electric field regions, where the insulator does not experience high electric fields, is called the low electric field region of the insulator.

Figures 2A, 2B, 2C, 2D, 2E, 2F, 2G, 2H, 2I, 2J, 2K, 2L, 2M:
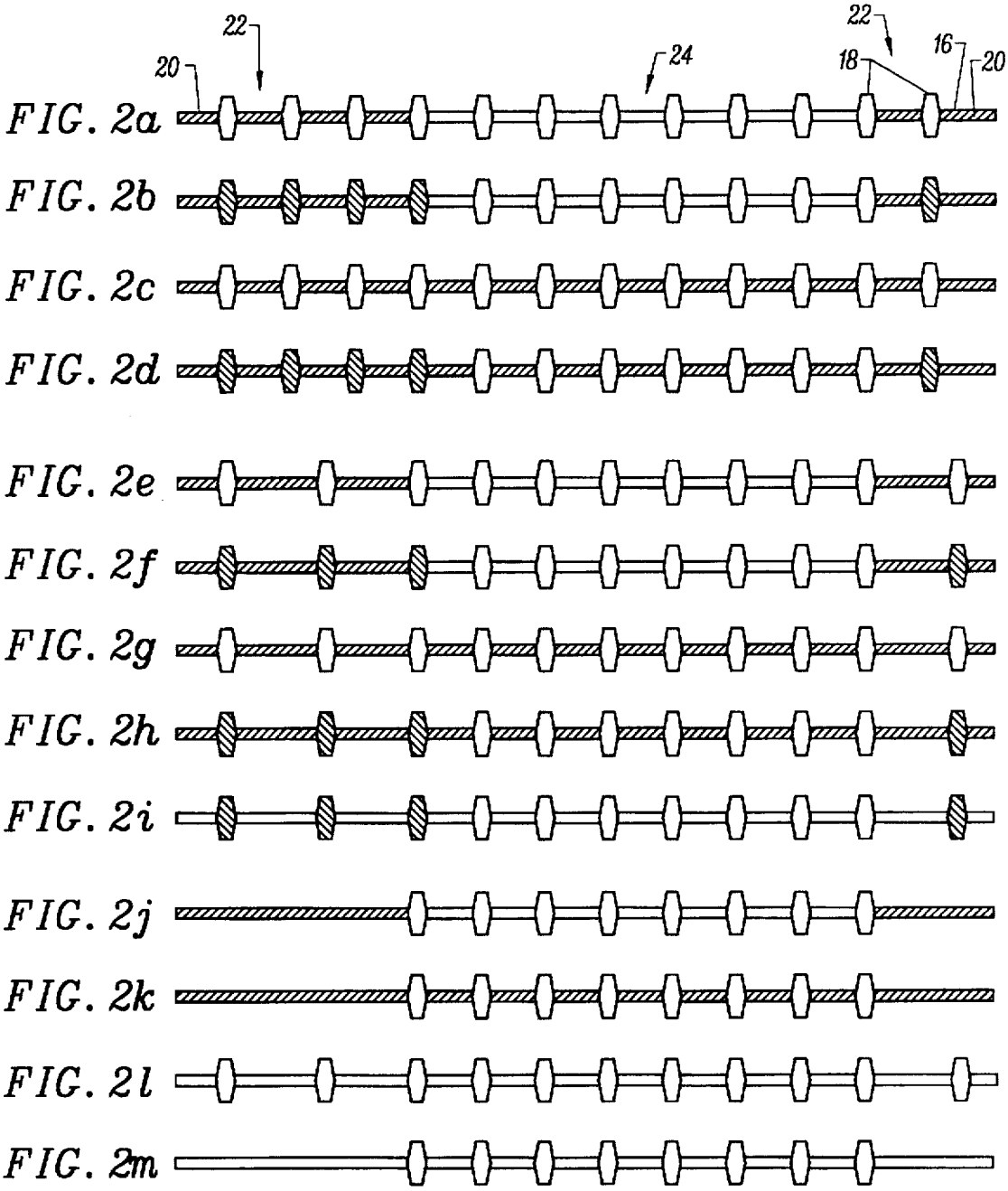
FIGS. 2(*a*)–2(*m*) illustrate alternate embodiments of a non-ceramic insulator according to the present invention.

FIGS. 2(*a*)–2(*m*) show several different embodiments of the non-ceramic insulator of the present invention. FIGS. 2(*a*)–2(*m*) are not exhaustive, but representative of some of the possible embodiments. In several embodiments, two different materials are used to form the outermost surface of the support structure 16 and the weather sheds 18. The first, more resistant material is more resistant to damage caused by electrical discharge than the second, less resistant material. In FIGS. 2(*a*)–2(*k*), hatched areas represent surfaces of the insulator which are formed of the first, more resistant material, and non-hatched areas represent surfaces of the insulator which are formed of the second, less resistant material.

For the purposes of this invention, the term resistant means resistant to deterioration or damage caused by electrical discharge. According to several embodiments of the invention, at least two materials are always used to form the outer surface of the insulator. Therefore, where a particular material is described herein as "more" or "less" resistant, this designation is used in reference to and in comparison with the other material(s) used to form the surface of the insulator.

FIGS. 2(*l*) and 2(*m*) show an alternative embodiment of the present invention wherein the entire surface of the insulator is formed of a hydrophobic material, such as a silicone rubber. In these embodiments, the geometry of the insulator is varied in order to reduce electrical discharge and thus reduce the damage to the insulator resulting from electrical discharge.

As described above in relation to FIG. 1, the insulator 10 is comprised of a support structure 16 to which is connected one or more weather sheds 18. In the embodiment of the invention shown in FIG. 2, the support structure 16 is shaped like a rod and the weather sheds 18 are disk-shaped, with the support structure 16 extending through each disk's center. At each end of the support structure 16 is a fitting area 20 which is suitable for connection to standard hardware for connecting the insulator to electrical conductors, transmission line towers, or other objects. FIG. 2 is diagrammatical, and does not intend to represent size, relative or otherwise, of the support structure 16, the weather sheds 18 or the fitting areas 20.

In a typical embodiment of this invention, the high electric field regions are associated with, and include, the fitting areas. Thus, in the specific case of FIG. 2, the high electric field regions 22 are at the two ends of the insulator. The low electric field region 24 is between the high electric field regions.

FIG. 2(*a*) shows an embodiment of the present invention wherein the surface of the support structure is formed of the first, more resistant material only in the high electric field regions of the insulator. All other surfaces of the insulator are formed of the second, less resistant material.

FIG. 2(*b*) shows an embodiment of the present invention wherein the surfaces of both the support structure and the weather sheds are formed of the first, more resistant material in the high electric field regions of the insulator and formed of the second, less resistant material in the low electric field region.

FIG. 2(*c*) shows an embodiment of the present invention wherein the entire surface of the support structure is formed of the first, more resistant material and all of the weather sheds are formed of the second, less resistant material.

FIG. 2(*d*) shows an embodiment of the present invention wherein the entire surface of the support structure is formed of the first, more resistant material. The surfaces of the weather sheds are formed of the second, less resistant material only in the high electric field region of the insulator.

FIGS. 2(*e*)–2(*i*) show several embodiments of the present invention wherein the weather shed spacing is varied depending upon the strength of the local electric field. Thus, in FIGS. 2(*e*)–2(*i*), the spacing between the weather sheds is greater in the high electric field regions than in the low electric field region. Note that in FIGS. 2(*e*)–2(*h*) the location of the two materials forming the surfaces is identical to the location of these materials in FIG. 2(*a*)–2(*d*), respectively. FIG. 2(*i*) shows an embodiment of the present invention wherein the only surfaces formed of the first, more resistant material are the surfaces of the weather sheds in the high electric field regions of the insulator.

FIGS. 2(*j*) and 2(*k*) show two embodiments of the present invention wherein there are no weather sheds in the high electric field regions of the insulator. FIG. 2(*j*) shows an embodiment of the present invention wherein the surface of the support structure is formed of the first, more resistant material in the high electric field regions and all other surfaces are formed of the second, less resistant material. FIG. 2(*k*) shows an embodiment of the present invention wherein the entire surface of the support structure is formed of the first, more resistant material, and all of the weather shed surfaces are formed of the second, less resistant material.

FIGS. 2(*l*) and 2(*m*) show two embodiments of the present invention herein the entire surface of the insulator is formed of a hydrophobic material such as a silicone rubber. In FIG. 2(*l*), the incidence of electrical discharge is reduced by increasing the spacing between the weather sheds in the high electrical field region. FIG. 2(*m*), represents the extreme of the weather shed spacing scheme shown in FIG. 2(*l*) where there are no weather sheds in the high electric field region.

Figure 3:
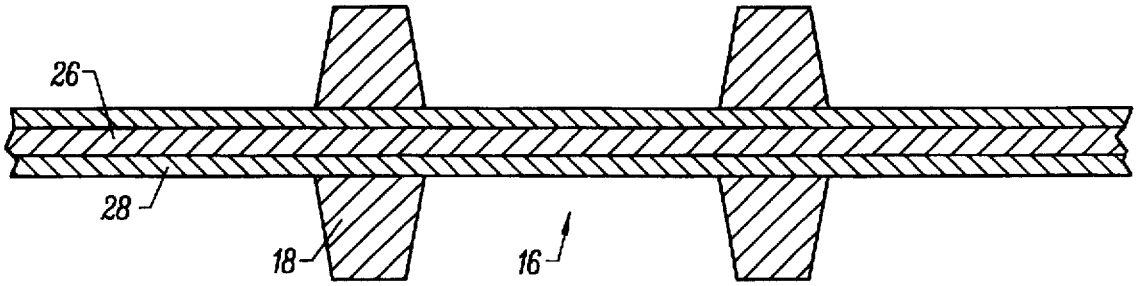
FIG. 3 is a cut-away view showing the internal structure of a typical non-ceramic insulator according to the present invention.

FIG. 3 shows a cross sectional view of a possible internal structure of the non-ceramic insulator according to the present invention. As shown, the support structure 16 is comprised of a central cylindrical rod 26, covered with a weather resistant protective surface covering, or sheath 28. The central cylindrical rod 26 could be made of pultruded fiberglass with continuous glass fibers. This rod may be crimped, glued or cast into end fittings compatible with standard hardware to connect the insulator to other objects.

The weather resistant coating or sheath 28 is usually plastic or rubber. This sheath is formed of either the first, more resistant material, or the second, less resistant material to suit the needs of the insulator design. Thus, the characteristics of the sheath determine the characteristics of the surface of the support structure of the insulator.

The weather sheds 18 are closely attached to the sheath, either through mechanical means or by cementing the sheds to the sheath. Alternatively, the weather sheds could be molded as an integral part of the sheath, the two then becoming one integral unit. The weather sheds are closely attached to the sheath to prevent voids between the weather sheds and the sheath. Such voids could trap water and contamination and lead to premature aging of the insulator.

Figure 4:
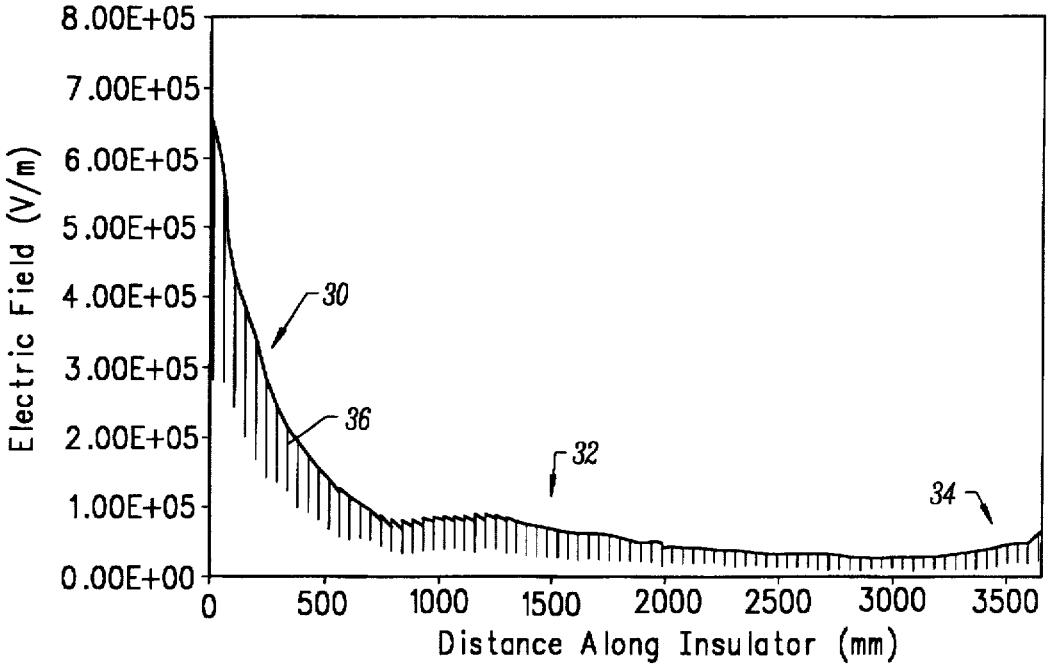
FIG. 4 is a chart showing the magnitude of the electric field along the length of a typical non-ceramic insulator according to the present invention.

FIG. 4 shows the strength of the electric field along the length of a typical non-ceramic insulator according to the present invention. The exact electric field around a particular insulator will vary greatly. The insulator measured in FIG. 4 is approx 3.65 meters long between the fitting areas, and has approximately 72 weather sheds along its length at 5 cm. intervals. The insulator was connected between electrical ground on the end corresponding to 3.6 meters and 289 KV rms on the end referenced at 0 meters.

FIG. 4 shows that the electric field on the surface of the insulator is highest at the end connected to the high-voltage conductor 30. The electric field decreases in the center of the insulator 32, and rises slightly at the ground end 34. FIG. 4 also shows that the electric field in the weather sheds 36 is much less than the field on the support structure between the weather sheds.

The onset of corona discharge in dry air typically occurs at an electric field strength of around 2.0–2.9 KV/mm. As a rule of thumb, to prevent corona activity on the surface of the insulator, the insulator is designed such that the electric field remains below 1 KV/mm. FIG. 4 shows that for the insulator of the current invention, the electric field strength is below 1 KV/mm for the entire surface of the insulator.

Figure 5:
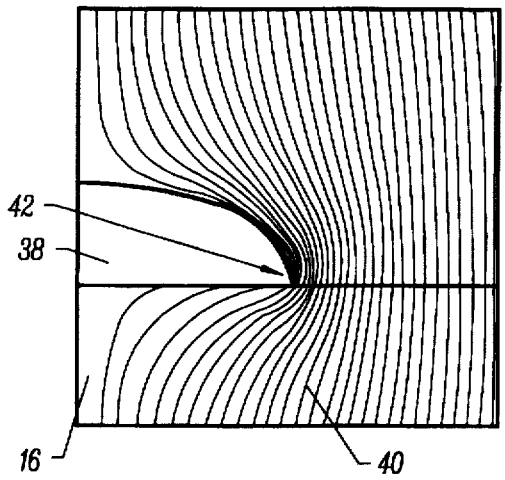
FIG. 5 is an illustration of an electric field in the presence of a water drop on a support structure of a non-ceramic insulator.

When water drops are present on the surface of the insulator, the inventors have discovered that the onset of corona activity occurs at a much lower electric field strength. FIG. 5 shows how the presence of a drop of water 38 on the surface of the support structure 16 affects the electric field. In FIG. 5, each vertical line 40 is an equipotential line. These equipotential lines are shown at 1 KV intervals. At the interface 42 of the water drop 38 and the support structure 16 the electric field lines are much closer together than in the surrounding areas. This bunching of the equipotential lines corresponds to an increase in the electric field caused by the water drop 38.

Figure 6:
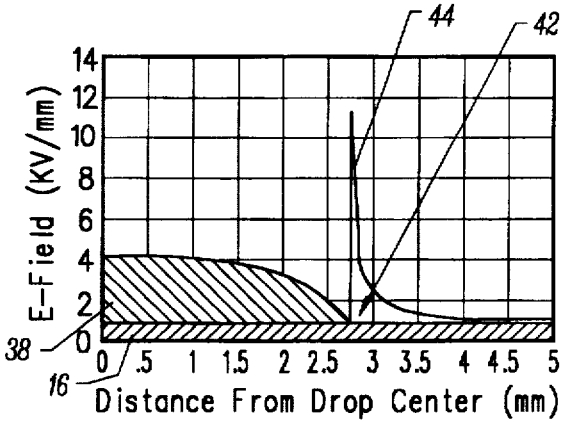
FIG. 6 is a chart showing the effect of a water drop on the magnitude of the local electric field.

FIG. 6 shows the results of the inventors' studies into the magnitude 44 of the increase in the electric field along the surface of the support structure 16 caused by the water drop 38. As shown, the highest electric field increase occurs at the interface 42 of the water drop 38 and the support structure 16. The inventors have found that presence of the water drop increases the electric field strength on the surface of the typical support structure to between 6 and 12 times the surrounding field strength.

This increase in the electric field caused by the water drop causes corona activity to occur at a much lower electric field strength compared to dry air. Thus, where the general electric field strength on the support structure is low, the electric field in the immediate vicinity of the water drop will be much higher, causing corona activity near the water drop when no corona activity would occur under dry conditions.

Figure 7A:
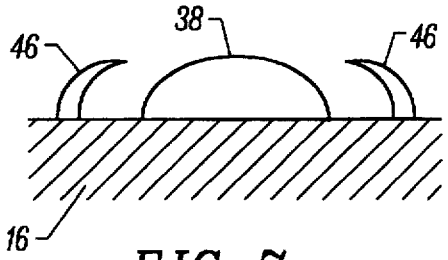
FIGS. 7(*a*)–7(*b*) show the relationship of corona activity to a water drop along a support structure and in proximity to a weather shed.
Figure 7B:
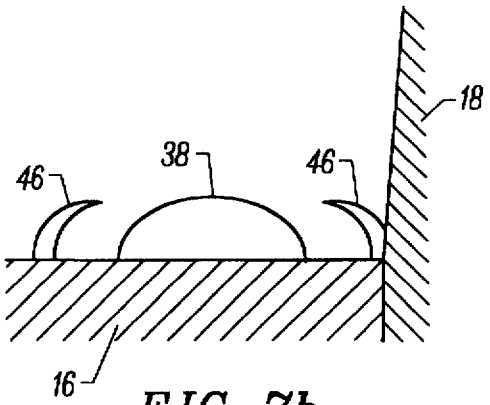

The inventors have observed the corona activity on typical non-ceramic insulators. FIGS. 7(*a*) and 7(*b*) show the position of the corona activity caused by the presence of a water drop 38 on the surface of the support structure 16. FIG. 7(*a*) shows that the corona activity 46 occurs on the surface of the support structure 16, resulting in damage to the structure.

FIG. 7(*b*) shows that where the water drop 38 is near the weather shed 18, support structure 16 interface, the corona activity 46 contacts a greater portion of the insulator surface. Additionally, the presence of the weather shed 18 causes an increase in the electric field at the weather shed 18, support structure 16 interface. Thus, the inventors have determined that the weather shed 18, support structure 16 interface is particularly vulnerable to erosion and other damage due to corona discharge 46.

On the other hand, the surface of the weather shed away from the support structure is not as vulnerable to corona discharge activity. The inventors have identified at least three reasons for this. One, the water drops on the surface of the weather shed do not increase the electric field strength as much as the water drops on the support structure. This is because the water drops on the surface of the weather shed do not present as great a discontinuity to the incident electric field. Second, the electric field on the surface of the weather shed in general is much lower than the electric field on the surface of the support structure. Finally, corona activity resulting from a water drop on the weather shed does not contact the surface of the weather shed.

The inventors have experimentally determined that the onset of corona activity around a water drop on the surface of the support structure occurs when the surrounding field strength is between 0.1 KV/mm and 1 KV/mm, and usually about 0.58 KV/mm. Therefore, an electric field strength above about 0.58 KV/mm will usually cause the onset of corona activity when water drops are present. The high electric field region of the insulator is defined as the region of the insulator where the electric field is high enough, or may become high enough during the life of the insulator, to cause corona activity in the presence of water drops.

The exact electric field, as well as the exact threshold electric field magnitude that will cause corona will vary widely within the range 0.1–1 KV/mm. Factors which the inventors have identified as influencing the threshold include the hydrophobicity of the insulator surface, the age of the insulator surface, the angle of contact between the water drops and the surface, the direction of the incident electric field, the geometry of the insulator and the surrounding conductors, and the presence and position of grading rings around the insulator.

In the example of FIG. 4, one end of the insulator experiences an elevated electric field 30. Assuming that the threshold electric field magnitude for the onset of corona for this particular insulator is 0.4 KV/mm, approximately 12 cm of the insulator will experience corona activity. An additional 5–10 cm may be expected to experience such activity as the insulator ages. Therefore, the insulator shown will have one high electric field region corresponding to the end experiencing the high electric field. As shown, the high electric field region for the insulator in FIG. 4 would include the fitting area for connecting the insulator to the high voltage conductor, the first 17–22 cm of the support structure and the first 2–4 weather sheds.

In sum, FIGS. 4–7 show the results of the inventors' discoveries relating to corona activity surrounding water drops on a non-ceramic insulator. As shown, water drops 38 on the surface of a non-ceramic insulator 10 can lead to corona activity 46 in proximity to the surface of the insulator 10. This is especially true in the high electric field regions 30 of the insulator 10. This corona activity 46, which occurs predominantly on the support structure 16 between weather sheds 18, degrades the insulator most severely at the interface of the support structure 16 and the weather shed 18. Furthermore, the weather sheds 18 cause the electric field to be greater near this interface point. It follows, therefore, that damage due to corona activity 46 may be minimized if either the water drops 38, the support structure/weather shed interfaces, or the weather sheds 18 themselves are eliminated. Also, damage to the insulator can be averted by forming the surface of portions of the insulator from a material which is resistant to damage caused by electrical discharge. These measures will have the greatest effect in the high electric field regions 30 of the insulator.

Accordingly, the present invention is based on the elimination of one or more of the conditions described above by:

1. Utilizing two materials in the construction of the surface of the insulator. The first type of material is resistant to damage caused by electrical discharge, and is used in high electric field areas and along the support structure where the damage due to electrical discharge is greatest. The second type of material is less resistant to damage caused by electrical discharge than the first type of material. This second type of material is used in areas of the insulator where damage due to electrical discharge is not a problem. In practice, materials of the second type are hydrophobic, while materials of the first type tend to lose their hydrophobicity in use.
2. Utilizing both hydrophobic and hydrophilic materials to form the outermost, exposed surface of the insulator 10. Hydrophobic materials are necessary to resist contamination and to prevent leakage currents from flowing across the surface of the insulator. Hydrophilic materials allow large leakage currents, but do not cause water drops, and therefore corona from water drops is not likely. Most importantly, available hydrophilic materials are generally resistant to aging caused by discharge activity.
3. Constructing the insulator 10 with variable weather shed 18 spacing dependant upon the strength of the local electric field. The weather shed 18 spacing in the high electric field region 30 of the insulator 10 is greater than the weather shed 18 spacing in the low electric field region 24. Such a design would have little effect on the overall leakage distance and, hence, flashover performance of the insulator 10.

Most non-ceramic materials used in the construction of the outermost surface of high voltage insulators are relatively hydrophobic when new. Some of these materials quickly lose their hydrophobicity when the insulator is subjected to normal use. Further, they do not regain their hydrophobicity. These materials, therefore, are no longer hydrophobic in use; instead, they are hydrophilic in use. For the purposes of this invention, therefore, the term "hydrophilic" is used to describe those materials which are hydrophilic in use as opposed to hydrophilic when new. Likewise, the term "hydrophobic" is used to describe those materials which are hydrophobic in use, i.e. they do not lose their hydrophobicity in use or they regain their hydrophobicity quickly after it is lost.

It is usually desirable to form the outermost surface of the insulator with a material which is hydrophobic. Hydrophobic materials are resistant to leakage currents and contamination problems. However, hydrophobic materials are generally not resistant to damage caused by electrical discharge. This means that an insulator whose surface is entirely formed of hydrophobic materials will eventually experience mechanical failure. Further, hydrophobic materials which are resistant to damage caused by electrical discharge may be hard to manufacture, expensive, or difficult to work with.

To alleviate these problems, the inventors have discovered that less-resistant hydrophobic materials may be replaced by more resistant materials, either hydrophilic or hydrophobic, in regions of the insulator which experience damage due to electrical discharge. The inventors have discovered the source of this damage, and have determined which areas are most susceptible to damage. Furthermore, they have determined that the two types of material may be combined on the insulator to gain the benefits of each type without sacrificing overall insulator performance.

As a result of their findings, the present invention involves constructing the outermost surface of the insulator out of two different materials or altering the geometry of the insulator to prevent water drop corona. The first material is chosen to have a high resistance to damage caused by electrical discharge, regardless of its hydrophobicity. Generally this means that the first material will be hydrophilic in use. The second material is chosen to be hydrophobic in use and will not be as resistant to damage caused by electrical discharge as the first material.

Generally, more resistant materials may be chosen to form the surface of the support structure 16 because the support structure 16 is the most likely to experience corona activity 46. Also, more resistant materials may be used in the high electric field regions 30 of the insulator 10 where corona activity 46 is most likely. In general, much of the insulator 10 surface must be hydrophobic for the insulator 10 to retain good contamination and flashover performance.

FIGS. 2(*a*)–2(*m*) illustrate how these principles can be incorporated into the design of an insulator. In FIGS. 2(*a*)–2(*h*) and 2(*h*)–2(*k*), the support structure has a surface formed of the first, more resistant material in the high electric field region. As noted above, the high electric field region is the region experiencing the most corona activity, and the support structure experiences more water drop corona activity than the weather sheds. The more resistant material in this region will resist the damage caused by this electrical activity. Also, using a more resistant material in the high electric field region will prevent water from forming drops because materials which are more resistant are generally hydrophilic. This helps reduce the corona activity on the insulator.

In FIGS. 2(*c*), 2(*d*), 2(*g*), 2(*h*), and 2(*k*), the entire surface of the support structure is formed of the first, more resistant material. As well as adding an extra measure of protection against damage and water drop corona, this may allow for easier insulator construction.

The weather sheds experience less water drop corona activity than the support structure, and therefore can be formed of the either the first, more resistant material or the second, less resistant material. In FIGS. 2(*b*), 2(*d*), 2(*f*), and 2(*h*), the surface formed of the first, more resistant material provides extra protection against erosion damage. In FIGS. 2(*a*), 2(*c*), 2(*e*), and 2(*g*), the weather sheds are formed of the second, less resistant, hydrophobic material to provide greater contamination and leakage current resistance. The trade off between contamination/leakage current resistance and water drop corona resistance will be made according to the needs of the design.

FIGS. 2(*e*)–2(*i*) and 2(*l*) show the second element in the design: increased weather shed spacing in the high electric field regions. The increased shed spacing both reduces the number of interfaces between weather sheds and the support structure and reduces the local electric field. Both of these have the effect of reducing electrical activity and the damage it causes.

FIGS. 2(*j*)–2(*k*) and 2(*m*) show an extreme condition of the variable weather shed spacing where no weather sheds are placed in the high electric field regions. Without weather sheds, the local electric field is reduced greatly, and there are no weather shed/support structure interfaces. The use of less resistant, hydrophobic material to form insulator surfaces in the low electric field region ensures that the insulator as a whole maintains its contamination and flashover performance.

FIGS. 2(*l*) and 2(*m*) show two embodiments of the present invention wherein the entire surface of the insulator is formed of a hydrophobic material such as a silicone rubber. As discussed above, hydrophilic materials are generally not very resistant to damage caused by electrical discharge. In FIGS. 2(*l*) and 2(*m*), therefore, the geometry of the insulator is changed to reduce the incidence of electrical discharge on the insulator surface. These embodiments might be of particular application where the insulator is exposed to extreme wet conditions, or where the insulator is used in a highly contaminated environment. In these environments, the contamination resistance of the hydrophobic material is of great importance, and therefore the entire surface of the insulator is formed of the hydrophobic material.

FIGS. 2(*a*)–2(*m*) are intended to show some of the many configurations of the current invention that are available to the designer. The exact choice of materials for the insulator surfaces and the exact weather shed spacing will be determined by the relative importance of corona resistance and flashover performance in the particular design. Additionally, where FIGS. 2(*a*)–2(*m*) show one particular shape for the support structure and the weather sheds, the invention is not limited to that shape. Instead, the principles guiding the design of insulators described herein can be applied to insulators of any shape.

Suitable less resistant materials include silicone rubbers. As discussed above, silicone rubbers are generally hydrophobic in use. Silicone rubbers come in several compositions, all known to the person skilled in the art. Suitable more resistant materials include Ethylene-Propylene (EP) type rubbers, including ethylene-propylene-diene-monomer (EPDM) and ethylene-propylene-monomer (EPM). EP-type rubbers are generally hydrophilic in use. As with the silicone rubbers, EP-type rubbers come in many compositions, all of which are known in the art.

In addition to constructing new non-ceramic insulators according to the present invention, old non-ceramic insulators may be retrofitted to take advantage of the aging-resistant properties of the present invention. In particular, the surfaces of some prior art non-ceramic insulators are entirely formed of less resistant materials such as silicone rubbers because such materials are generally hydrophobic. Portions of these surfaces may be coated or covered with a more resistant material such as an EP-type rubber, or a more resistant hydrophobic rubber, to achieve the same benefits as new non-ceramic insulators constructed according to the present invention.

This may be accomplished by covering the support structure of the old nonceramic insulators with sheaths of the more resistant material. Likewise, tape made out of a more resistant material may be applied over the surface of the old insulator. Alternatively, the more resistant material may be painted or molded onto the surface of the old insulator in a liquid form which would later harden. Thus, the surface of the insulator in the high electric field region would be resistant to water drops and associated corona activity, while the majority of the surface of the insulator would remain hydrophobic to prevent contamination and flashover.

The foregoing description, for purposes of explanation, used specific nomenclature to provide a thorough understanding of the invention. However, it will be apparent to one skilled in the art that the specific details are not required in order to practice the invention. In other instances, the insulator shape and size was shown in diagrammatical form in order to avoid unnecessary distraction from the underlying invention. Thus, the foregoing descriptions of specific embodiments of the present invention are presented for purposes of illustration and description. They are not intended to be exhaustive or to limit the invention to the precise forms disclosed, obviously many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated. It is intended that the scope of the invention be defined by the following claims and their equivalents.

We claim:

1. A non-ceramic insulator for a high-voltage electrical conductor, comprising:

a support structure for supporting said high-voltage electrical conductor; and one or more weather sheds positioned on said support structure;

wherein a first portion of said non-ceramic insulator is composed of an ethylene-propylene type rubber, and a second portion of said non-ceramic insulator is composed of a silicone rubber, said ethylene-propylene type rubber having a greater resistance to damage caused by electrical discharged than said silicone rubber.

2. A non-ceramic insulator for a high-voltage electrical conductor, comprising:

a support structure for supporting said high-voltage electrical conductor;

one or more weather sheds positioned on said support structure;

wherein a first portion of said non-ceramic insulator is composed of a first material and a second portion of said non-ceramic insulator is composed of a second material, said first material having a greater resistance to damage caused by electrical discharge than said second material, wherein said support structure includes a first fitting area for coupling to said high-voltage electrical conductor, a second fitting area for coupling to a tower, and a central region therebetween; and first spacers between said weather sheds in said first and second fitting areas, which or larger than second spacers between said whether shed in said central region.

3. A method of retrofitting an existing high-voltage non-ceramic insulator consisting of a support structure and one or more weather sheds, said method comprising the steps of:

forming a first surface composed of a first material on a first portion of said non-ceramic insulator; and creating a second surface composed of a second material on a second portion of said non-ceramic insulator, said first material having a greater resistance to damage caused by electrical discharge than said second material, wherein said forming step includes the step of forming an ethylene-propylene type rubber and said creating step includes the step of creating a silicone rubber.

* * * * *